US006301804B1

(12) United States Patent
Battaglia

(10) Patent No.: US 6,301,804 B1
(45) Date of Patent: Oct. 16, 2001

(54) BOOT TRACTION DEVICE

(76) Inventor: Vincent P. Battaglia, 209 Banks Rd., Easton, CT (US) 06612

( * ) Notice: Subject to any disclaimer, the term of this patent is extended or adjusted under 35 U.S.C. 154(b) by 0 days.

(21) Appl. No.: 09/482,472

(22) Filed: Jan. 12, 2000

(51) Int. Cl.[7] ..... A43B 5/00
(52) U.S. Cl. ..... 36/7.6; 36/62; 36/64
(58) Field of Search ..... 36/7.7, 7.6, 62, 36/64, 65, 66, 59 R, 97

(56) References Cited

U.S. PATENT DOCUMENTS 788,302 * 4/1905 Bartley ..... 36/62
914,780 * 3/1909 Auer ..... 36/62
1,182,787 * 5/1916 Murphy ..... 36/7.6
1,277,924 * 9/1918 Heinzer ..... 36/7.6
1,429,259 * 9/1922 Tagliaferry ..... 36/62
1,837,730 * 12/1931 Smith ..... 36/7.6
2,956,351 * 10/1960 Moon ..... 36/7.7
3,685,173 * 8/1972 Piazza ..... 36/64
5,357,692 * 10/1994 Murray ..... 36/62
5,794,367 * 8/1998 Carroll ..... 36/134

* cited by examiner

*Primary Examiner*—Paul T. Sewell
*Assistant Examiner*—Troy Arnold
(74) *Attorney, Agent, or Firm*—DeLio & Peterson LLC

(57) ABSTRACT

A boot traction device or adapter that can be attached to the bottom of a person's footwear, which is removable, adjustable as well as lightweight. In manufacturing the present invention, a single style of sole plate can be configured for either a right or a left foot. The device can be adapted to fit onto any size of shoe or footwear and adjustable strap connectors are used to secure the adapter to the footwear. Threaded openings are provided for the attachment of gripping cleats or other devices to the adapter. Furthermore, the design of the adapter is such that an optional heel plate can be connected to the sole plate.

22 Claims, 4 Drawing Sheets

BOOT TRACTION DEVICE

BACKGROUND OF THE INVENTION

1. Field of the Invention

The present invention is related generally to a footwear adapter and in particular to an adjustable boot traction device.

2. Description of Related Art

Traction devices and adapters for other types of devices to be strapped onto boots are known in the prior art. Such adapters include add on devices such as gripping cleats, ice skates, snowshoes, climbing spikes, ski bindings. Typically, straps or other mechanisms are used to secure the adapters to the bottom of the footwear. As used herein the term "footwear" refers to outer footwear such as boots, shoes and the like which are worn on the exterior of the foot and do not include socks or the like which are normally worn beneath such footwear.

Problems encountered in prior art footwear adapters include the necessity to modify the adapter for different sizes of footwear. This presents a problem of requiring a relatively large inventory to account for different footwear lengths and widths, as well as adapting the footwear for the right or left foot. While many adapters are adjustable in size, most are rather unwieldy and still present complexities in manufacturing.

Bearing in mind the problems and deficiencies of the prior art, it is therefore an object of the present invention to provide an improved footwear adapter for the various footwear devices described previously.

It is another object of the present invention to provide a footwear adapter which provides for simplified fitting to various sized footwear.

A further object of the invention is to provide a footwear adapter which is relatively easy to manufacture.

It is yet another object of the present invention to provide a footwear adapter which requires reduced inventory for different size and right/left footwear.

Still other objects and advantages of the invention will in part be obvious and will in part be apparent from the specification.

SUMMARY OF THE INVENTION

The above and other objects, which will be apparent to those skilled in the art, are achieved in the present invention which relates to a footwear adapter having a sole plate with one or more openings in the plate for attachment of a strap connector, an adjustable strap connector with a first portion and a second portion. In the preferred embodiment, the sole plate opening has a dimension extending inward with respect to an edge of the sole plate. The first portion of the adjustable strap connector is received in the opening, and the second portion, which is distal the first portion, extends outward from the sole plate. The first portion is positionable within the sole plate opening in different rigid positions along the inwardly extending dimension. A strap is attached to the strap connector at the second portion to secure the sole plate to the footwear article.

In the preferred embodiment, the first portion of the strap connector is in the same plane as the opening in the sole plate. It is also preferred that the sole plate openings, which are preferably rectangular with a larger length along the inwardly extending dimension, and the strap connector first portion have complimentary teeth adapted to position the first portion of the strap connector within the sole plate opening in different positions.

The footwear adapter may also include gripping cleats on a lower surface of the sole plate. Threaded openings may be provided in the sole plate, preferably a lower surface of the sole plate, to receive the complimentary threaded portions of the gripping cleats.

It is also preferred that the sole plate be adapted to conform to the forward region of the footwear article and further include a heel plate adapted to conform to the rearward portion of the footwear article. In the preferred embodiment, the sole plate and heel plate are adjustably connected so that the distance between the sole plate and heel plate can be varied. Preferably, chain links are used to connect the sole and heel plates, with the chain links being adjustable for pitch and the number of links, in order to vary the distance between the plates.

The footwear adapter may also include one or more openings in the heel plate which receive the strap connector. The heel plate may have a dimension extending inward with respect to an edge of the heel plate. Preferably, a first portion of the adjustable strap connector is received within the heel plate opening and a second portion, which is distal from the first portion, extends outward from the heel plate. It is also preferred that the first portion of the strap connector is positionable in the heel plate opening in different rigid positions along the inwardly extending dimension, and a strap is attached to the strap connector at the second portion to secure the heel plate to the footwear.

In one aspect, the footwear adapter may also include openings on opposite edges of the heel plate, with a strap connector adjustably positioned within each of the heel plate openings. In the preferred embodiment, at least one strap is attached to each of the strap connectors at the second portion to secure the heel plate to the footwear.

The footwear adapted may also include openings on opposite edges of the sole plate and a strap connector adjustably positioned within each of the sole plate openings. It is preferred that at least one strap is attached to each strap connector at the second portion in order to secure the sole plate to the footwear. In the preferred embodiment, the strap connector first portion extends essentially in the plane of the sole plate conforming to the underside of the footwear article, with the strap connector second portion extending upward in a direction conforming to the side of the footwear article. It is also preferred that the sole plate openings, which are preferably rectangular, and the strap connector first portion have complimentary teeth, where the sole plate teeth extend along the inwardly extending dimension, are adapted to position the first portion of the strap connector within, and in the same plane as, the sole plate opening in different positions.

In another aspect, the present invention is directed to a sole plate, a heel plate, chain links connecting the sole and heel plates, strap connectors, and a strap to secure the sole and heel plate to the footwear article. In the preferred embodiment, the sole plate conforms to the underside of a forward region, and the heel plate conforms to the underside of a rearward portion, of the footwear article. The chain links are various size and pitch chain links, and are preferably adjustable for pitch and number of links to vary the distance between the sole and heel plates. The strap connectors are secured to the sole plate and extend outward, with the strap attached to the strap connector.

Preferably, the strap connector includes at least one tab extending outward adjacent to and above the first portion for contacting the sole plate adjacent the opening, and the strap connector first portion has a threaded opening therein. A threaded fastener having a width greater than the opening in the sole plate may be secured in the strap connector portion threaded opening from a side opposite the at least one tab. The threaded fastener and the at least one tab cooperate to secure the strap connector in the opening in the sole plate. Preferably, the threaded fastener comprises a gripping cleat.

In another aspect, the present invention is directed to a footwear adapter comprising a detachable sole plate conforming to the underside of a footwear article, one or more threaded openings in the sole plate to receive a gripping cleat, one or more gripping cleats having complimentary threaded portions received in the threaded openings on a lower surface therefrom, strap connectors secured to the sole plate and the heel plate and extending therefrom, and one or more straps attached to the strap connectors for securing the sole plate and heel plate to the footwear article. In the preferred embodiment, the strap connectors are secured in openings in the sole and heel plates and further include threaded openings in the strap connectors and gripping cleats having complimentary threaded portions received in the threaded openings in the strap connectors. The footwear adapter may also include washers between the gripping cleats and the strap connectors to secure the cleats.

In yet another aspect, the present invention is directed to a method of making a footwear adapter. The method comprises the steps of providing a sole plate conforming to the underside of a footwear article, providing an essentially flat strap connector of a fixed length, determining the width of a footwear article to which the footwear adapter is to be fitted and bending the strap connector to conform to the width of the footwear article. In the preferred embodiment, the sole plate has an opening for receiving a strap connector with the opening having a dimension extending inward with respect to an edge of the sole plate. It is also preferred that the strap connector have a first portion adapted to be received within the sole plate opening and a second portion distal from the first portion adapted to receive a strap. The first portion is preferably positionable within the sole plate opening in different rigid positions along the inwardly extending dimension. It is also preferred that the strap connector be bent so that the second portion extends outward and upward from the first portion to conform to the width of the footwear article.

In a further aspect, the present invention is directed to a method of making a footwear adapter comprising providing an essentially flat asymmetrical sole plate of fixed length having a forward portion and a rearward portion. The sole plate preferably has a configuration conforming on one surface to the underside of a right footwear article and conforming on the opposite surface to the under side of a left footwear article. A strap connector is provided which has a first portion adapted to be secured to the sole plate opening and a second portion distal from the first portion adapted to receive a strap. It is determined whether the sole plate is to be fitted to a right or left footwear article, and the sole plate is bent so that the forward portion extends upwardly at an angle with respect to the rearward portion when the sole plate surface conforming to the determined right or left footwear article is up.

In another aspect, the present invention is directed to a method of fitting a footwear adapter. The method comprises providing a sole plate conforming to the underside of a footwear article and having one or more openings for receiving a strap, providing an adjustable strap connector, providing a strap having a first and second portion adapted to be attached to the strap connector, inserting the second portion of the strap connector into the sole plate opening and adjusting the position of the strap connector first portion to a rigid position to fit the width of the footwear article, applying the sole plate to the underside of the footwear article, and adjusting the strap in the second portion of the strap connector to secure the sole plate to the footwear article. In the preferred embodiment, the sole plate opening has a dimension extending inward with respect to an edge of the sole plate. It is also preferred that the first portion of the strap be adapted to be received within the sole plate opening and that the second portion be distal from the first portion and extend outward therefrom. Preferably, the first portion of the strap connector is positionable within the sole plate opening in different rigid positions along the inwardly extending dimension.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
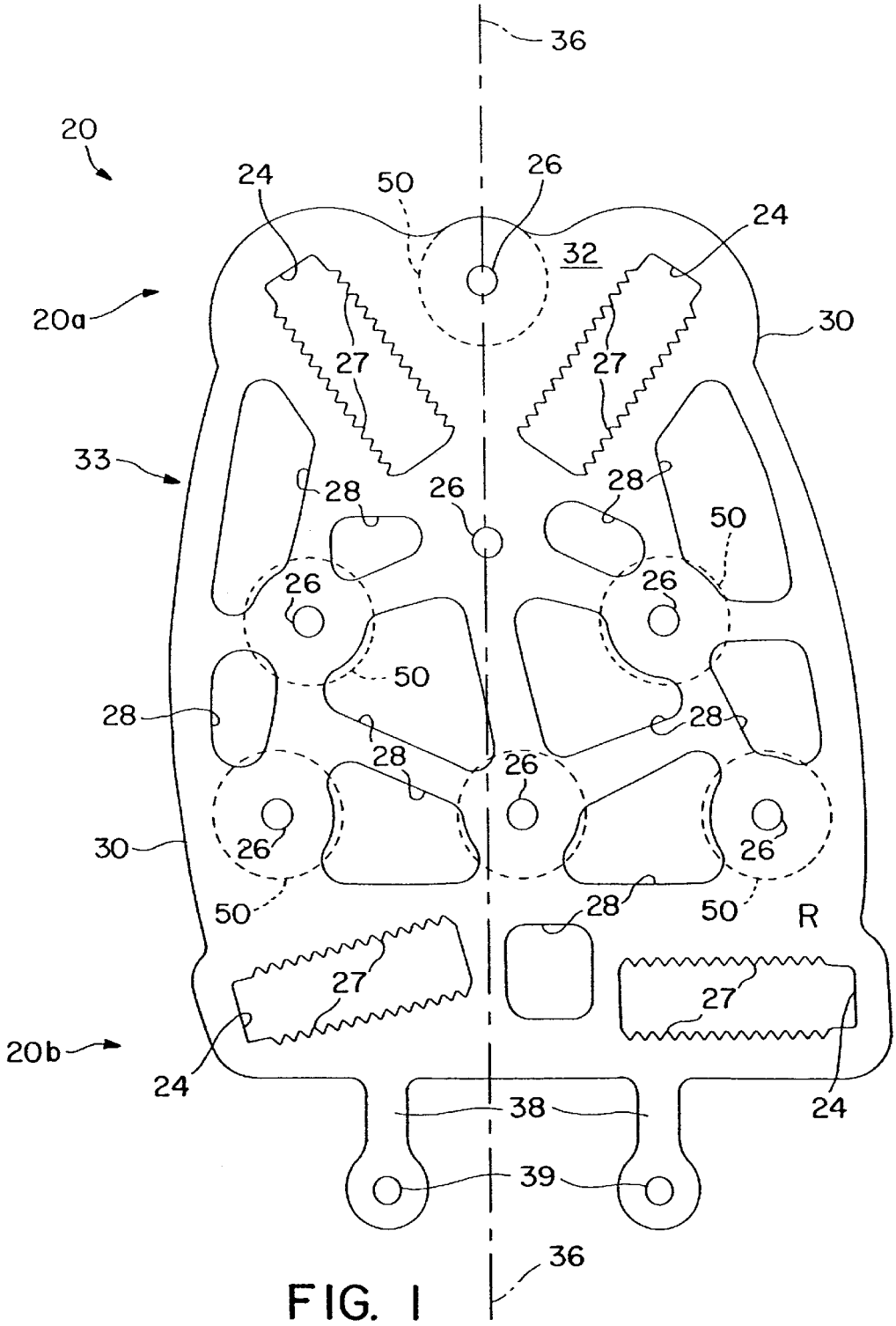
FIG. 1 is a top plan view of the preferred sole plate of the present invention.
Figure 2:
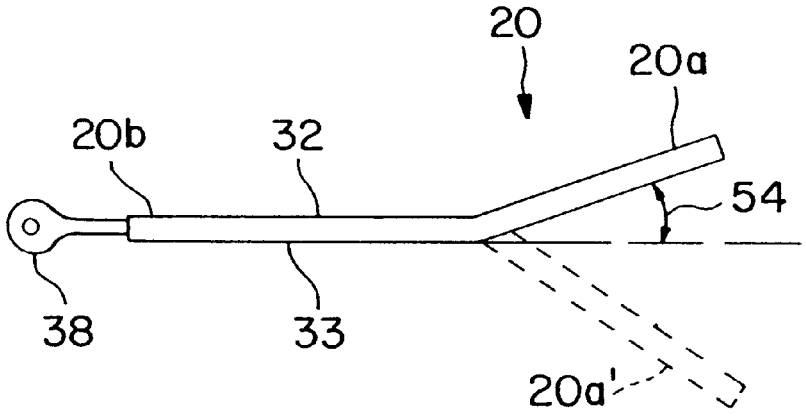
FIG. 2 is a side elevational view of the sole plate of FIG. 1.

In describing the preferred embodiment of the present invention, reference will be made herein to FIGS. 1–5 of the drawings in which like numerals refer to like features of the invention. Features of the invention are not necessarily shown to scale in the drawings.

The preferred footwear adapter of the present invention is manufactured from a metal plate for example steel, stainless steel or aluminum of a suitable thickness to provide proper strength. In the case of steel, such thickness may range from 0.050 in. to 0.100 in. in thickness. Preferably the metal is provided in a strip form which may be easily fed into a conventional blanking press for stamping, bending and otherwise to form the configurations described below.

Initially, the blanking press may form a sole plate 20 which is asymmetrical about an axis 36 which conforms to the longitudinal direction of the footwear. The sole plate 20 is configured so that when one surface e.g. surface 32 is up (FIGS. 1 and 3), the sole plate is configured to fit the right foot of a footwear article and when flipped over so that the opposite surface 33 is up, the sole plate is configured to fit the left foot of the footwear article. The sole plate is stamped with a relatively square outer edge 30 and within the outer edge a series of openings 24, 26 and 28. Openings 24 preferably comprise a plurality of, e.g., 4, rectangular openings which extend with the longer dimension extending inward from outer edge 30. Along this longer dimension extend a series of teeth 27 in the edge of opening 24 which are sized and configured to compliment teeth in an adjustable strap connector to be discussed further below. Openings 26 are circular and may be threaded to receive gripper cleats or other devices which will be discussed further below.

Finally, other openings 28 are stamped within sole plate 20 to reduce weight while still providing sufficient strength and rigidity within the remaining plate. Along a rearward portion 20*b* of sole plate 20, there extends from the outer edge a pair of lugs 38 having openings 39 therein for connection to an optional heel plate. If no heel plate is utilized, these lugs 38 may be removed by the blanking press or other device. All of the aforesaid structure may be easily produced in a conventional blanking press which will form the outer edge 30 and openings 24 (with the teeth) 26 and 28. A separate subsequent threading operation is normally employed to thread openings 26. A separate device may also be utilized to form the twist in lugs 38.

In order to simplify manufacture and reduce inventory, sole plate 20 is initially formed so that it is essentially flat, and may be stored in inventory. When it is desired to conform to either a right footwear article or left footwear article, a bend is made to lift up the forward portion 20*a* at an angle with respect to the rearward portion. As shown in the side view in FIG. 2, the sole plate 20 is placed with surface 32 upward and surface 33 downward so that it conforms to the right foot of the footwear article. Forward portion 20*a* is then bent to produce a desired angle 54 with respect to the rearward portion 20*b*. If a left foot footwear article is desired, the opposite bend would be made that would result in a forward portion 20*a'* as shown in phantom lines. Thus, only one style of sole plate needs to be initially manufactured to fit either the right foot or left foot of the footwear article. Once the desired size is determined, then the same sole plate can be formed to make either the left foot or right foot of the footwear article.

Figure 3:
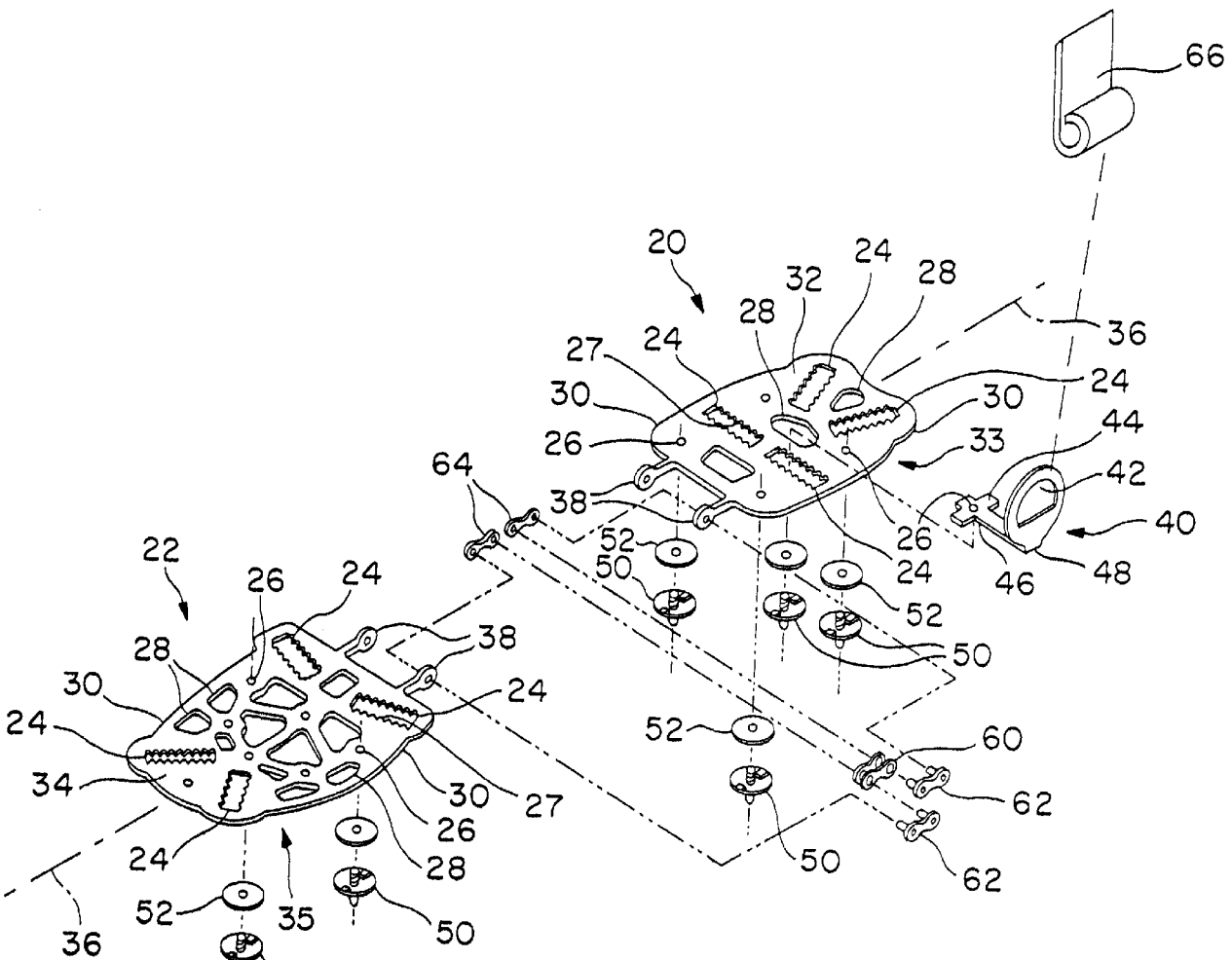
FIG. 3 is an exploded, perspective view of the preferred footwear adapter of the present invention employing the sole plate of FIG. 2 and a heel plate.
Figure 5:
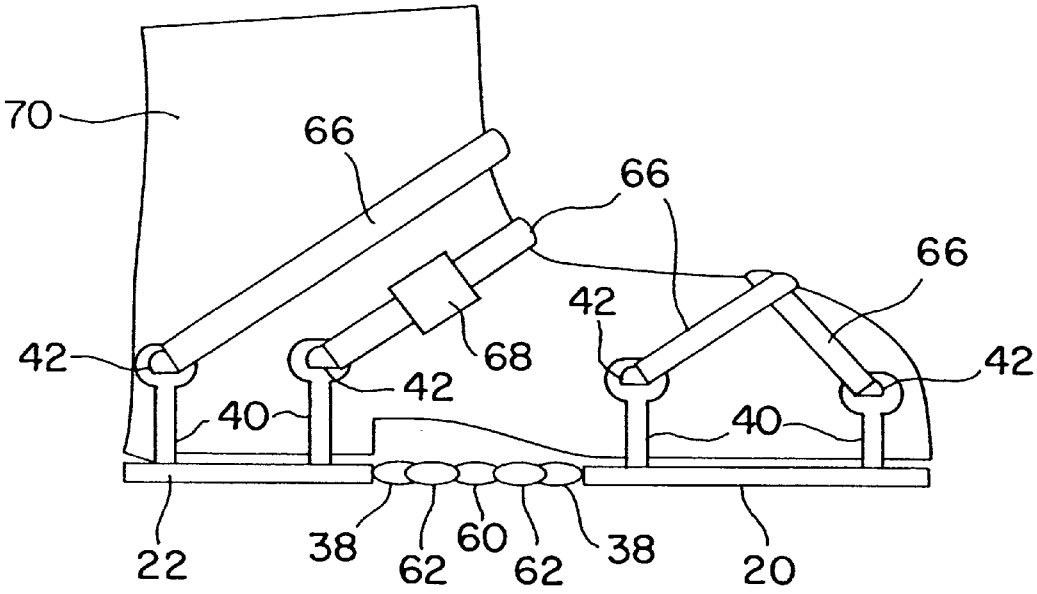
FIG. 5 is a side elevational view of the preferred footwear connector of the present invention attached to a footwear article.

If a heel portion is desired for the footwear adapter, there may be formed a heel plate 22 in a manner similar to that of sole plate 20. As shown in FIG. 3, heel plate 22 similarly contains rectangular connector openings 24 extending inward along the longer length dimension and with teeth 27 along that same longer length dimension. Threaded openings 26 are again provided for gripping cleats or other devices and weight saving openings 28 as well. Lugs 38 are also formed along the forward portion of heel plate 22 for connection to the lugs on sole plate 20. Since the heel plate 22 is normally flat, the bending operation described in connection with sole plate 20 is normally not required. Again, like sole plate 20, heel plate 22 is asymmetrical with respect to axis 36 so that it can be flipped from one surface to the other to be used either on the right foot article or left foot article. To connect the sole and heel plates, any manner of connection may be employed. Preferably the connection is flexible such as a strap, or more preferably a chain link, such as a conventional bicycle chain link. As shown therein, conventional bicycle chain link components 60, 62, and 64 are assembled and connected to the openings in the lugs 38 in the sole and heel plate to connect the two. Since footwear varies in length, either different pitch (length) chain links can be utilized or more or fewer chain links can be employed to vary the distance between the sole plate 20 and heel plate 22.

If gripping cleats are to be employed, preferably a conventional metal golfer's cleat of the type known in the prior art may be employed except that instead of securing them directly to the footwear, they are secured to the footwear adapter of the present invention. Such gripping cleats 50 normally have an upper cup portion 51 from which the cleat portion extends below. The cleat has a threaded portion which is received within threaded openings 26 in the sole and/or heel plate and tightened until the cup portion 51 deforms in order to lock the cleat securely in place. Since the gripping cleat may also be threaded into threaded opening 26 in the strap connector 40 which is itself within connector opening 24 in the sole or heel plate, it is preferred to utilize an intermediate lock washer 52 so that the gripping cleat is securely tightened. Preferably, the gripping cleats secure the strap connectors 40 into the openings 24 in the sole and heel plates since tabs 44 extend above and outside openings 24 edges and cup portion 51 extends below and outside opening 24 edges. Alternatively, another threaded fastener having a width greater than opening 24, but without the cleat portion, may be used to secure the strap connectors in their respective openings.

Figure 4:
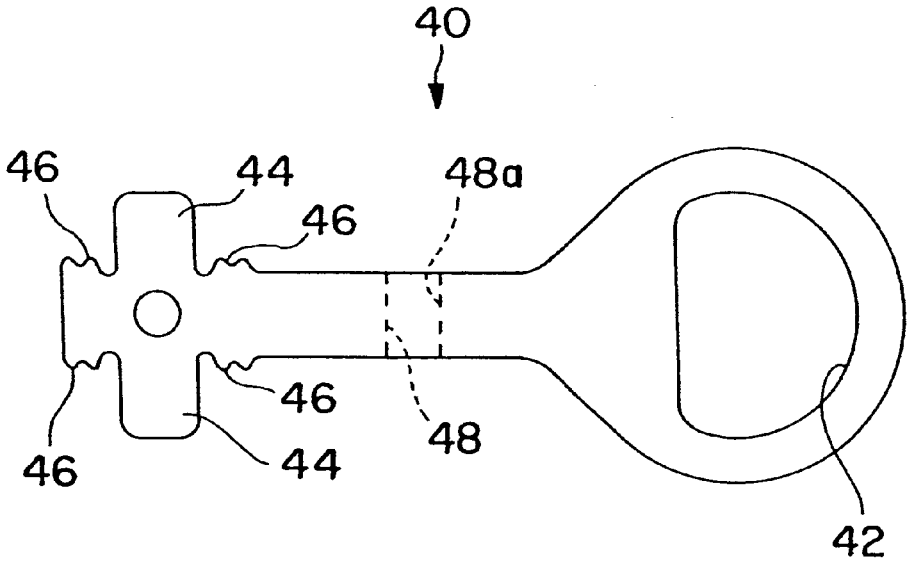
FIG. 4 is a top plan view of the preferred strap connector of the present invention, prior to bending.

The strap connector 40 also includes particular features that enable the present invention to achieve the objects described above. Initially, strap connector 40 may be made from a metal strip of the type described above. To reduce inventory requirements, the strap connector 40 is initially manufactured so that it is essentially flat (FIG. 4). At a first portion on one end of the strap connector, there are formed a pair of tabs 44 extending approximately 90° from the longitudinal axis (longer length) of the strap connector. These tabs are formed upward so that they are out of the plane of the remaining first portion of the strap connector which contains on the outward edges connector teeth 46 which are sized and configured to engage the teeth 27 within the openings 26 of the sole and/or heel plates. Both the sole plate opening teeth 27 and the strap connector teeth 46 are symmetrical about the longitudinal axes of the opening and connector, respectively. When the strap connector is engaged into the openings 24 of the sole and/or heel plates, the first portion teeth 46 of the strap connector are in the same plane as the sole and/or heel plates, with the strap connector tabs 44 at a slightly higher plane to contact the surfaces of the sole and/or heel plates adjacent openings 24 to stabilize the strap connector therein. At the end opposite the first portion of the strap connector, there is a second portion which contains an opening 42 for receiving the strap which opening is preferably curved e.g. semicircular so that the strap may move easily at an angle thereto. In its final configuration, the second portion of the strap connector 40 is bent at bend point 48 to an angle of approximately 90° with respect to the first portion so that the second portion extends outward and upward alongside the side of the footwear article to which the adapter is secured. Since the widths of the footwear articles vary greatly, the strap connector, which is flat as manufactured, may be kept in inventory and once the desired footwear width is determined, the bend 48 is imparted to the strap connector so that a single strap connector can accommodate various widths of footwear to further provide for adjustment to fit varying widths of footwear. As shown in FIG. 4, bend point 48 may be repositioned to 48*a* if it is desired to use the strap connector with a wider footwear article.

Additionally, the final formed strap connector may be further adjusted to accommodate different widths of footwear articles. The first portion 26 which is received within the sole plate opening 24 may be removed and repositioned in a plurality of different rigid positions by simply disengaging and reengaging the complimentary teeth 27, 46. Since the sole of the footwear article contacts both the upper surface 32 of the sole plate (and upper surface 34 of the heel plate) as well as the upper surface of the first portion of the strap connector, this maintains tight engagement of the strap connector 40 within the strap connector openings 24 in the sole and heel plates.

To secure the footwear adapter of the present invention to the footwear article, conventional flexible straps 66 may be employed which are secured within the strap connector openings 42 and wrapped around the upper side and rear of the footwear article 70 (FIG. 5), optionally using conventional snaps or connectors 68 and adjusters, to fit the footwear adapter snugly to the footwear article. As used herein, the strap useful for the present invention includes any woven, flexible or inflexible band, strip, cord, lash or belt which may be secured to the strap connector opening and wrapped around at least one portion of the footwear article to secure the sole and/or heel plate thereto. Such strap preferably includes a buckle, connector or adjuster to ensure a sufficient adjustable or self-ratcheting fit to the footwear article. The types of strap bindings used in snowboard or ski bindings may be used in the present invention.

In addition to the gripping cleats, other devices may be connected to the footwear adapter such as those described above. These include ice skate blades, snowshoes, climbing spikes, ski or snowboard bindings and the like which are secured to and below the sole plate and/or heel plate.

Thus the footwear adapter of the present invention achieves the objects described above. The footwear adapter described herein which provides for simplified fitting to various sized footwear, is relatively easy to manufacture, and requires reduced inventory for different size and right/left footwear.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A footwear adapter comprising:

a sole plate conforming to the underside of a footwear article;

at least one opening through said sole plate for receiving a strap connector, the sole plate opening having a dimension extending inward with respect to an edge of the sole plate and further having teeth formed along opposite edges of the inward extending dimension;

an adjustable strap connector having a first portion received within and in the same plane as the opening in the sole plate opening and a second portion distal from the first portion and extending outward from the sole plate, the first portion of the strap connector having teeth complimentary to and engaging with the teeth in the sole plate opening and being positionable within the sole plate opening in different rigid positions along the inwardly extending dimension; and a strap attached to the strap connector at the second portion for securing said sole plate to the footwear article.

2. The footwear adapter of claim 1 wherein the sole plate openings are rectangular with a larger length along the inwardly extending dimension.

3. The footwear adapter of claim 1 further including gripping cleats on a lower surface of the sole plate.

4. The footwear adapter of claim 1 further including threaded openings in the sole plate for receiving gripping cleats, and gripping cleats having complimentarily threaded portions received in the threaded openings on a lower surface of the sole plate.

5. The footwear adapter of claim 1 wherein the sole plate is adapted to conform to the forward region of the footwear article and further including a heel plate adapted to conform to the rearward region of the footwear article, the sole plate and the heel plate being adjustably connected to vary distance therebetween.

6. The footwear adapter of claim 5 further including chain links connecting the sole and heel plates, the chain links being adjustable for pitch and number of links to vary the distance between the sole and heel plates.

7. The footwear adapter of claim 5 including at least one opening in said heel plate for receiving a strap connector, the heel plate opening having a dimension extending inward with respect to an edge of the heel plate; an adjustable strap connector having a first portion received within the heel plate opening and a second portion distal from the first portion and extending outward from the heel plate, the first portion of the strap connector being positionable within the heel plate opening in different rigid positions along the inwardly extending dimension; and a strap attached to the strap connector at the second portion for securing said heel plate to the footwear.

8. The footwear adapter of claim 5 including said openings on opposite edges of said heel plate, a strap connector adjustably positioned within each of the heel plate openings, and at least one strap attached to each of the strap connectors at the second portion for securing said heel plate to the footwear.

9. The footwear adapter of claim 1 including said openings on opposite edges of said sole plate, a strap connector adjustably positioned within each of the sole plate openings, and at least one strap attached to each of the strap connectors at the second portion for securing said sole plate to the footwear.

10. The footwear adapter of claim 1 wherein said strap connector first portion extends essentially in the plane of the sole plate conforming to the underside of a footwear article and the strap connector second portion extends upward in a direction conforming to the side of a footwear article.

11. The footwear adapter of claim 1 wherein the strap connector includes at least one tab extending outward adjacent to and above the first portion for contacting said sole plate adjacent the opening.

12. The footwear adapter of claim 11 wherein the strap connector first portion has a threaded opening therein and further including a threaded fastener having a width greater than the opening in the sole plate secured in the strap connector portion threaded opening from a side opposite said at least one tab, said threaded fastener and said at least one tab cooperating to secure said strap connector in the opening in said sole plate.

13. The footwear adapter of claim 12 wherein said threaded fastener comprises a gripping cleat.

14. A footwear adapter comprising:

a sole plate conforming to the underside of a forward region of a footwear article;

a heel plate conforming to the underside of a rearward region of a footwear article;

chain links connecting the sole and heel plates, the chain links being adjustable for pitch and number of links to vary distance between the sole and heel plates;

strap connectors secured to said sole plate and said heel plate and extending outward therefrom; and at least one strap attached to the strap connectors for securing said sole plate and said heel plate to the footwear article.

15. The footwear adapter of claim 14 wherein the chain links comprise various size and pitch chain links.

16. A method of making a footwear adapter comprising:

providing an essentially flat asymmetrical, metal sole plate of fixed length having a forward portion and a rearward portion, the sole plate having a configuration conforming on one surface to the underside of a right footwear article and conforming on the opposite surface to the underside of a left footwear article;

providing a strap connector having a first portion adapted to be secured to the sole plate opening and a second portion distal from the first portion adapted to receive a strap;

determining whether the sole plate is to be fitted to a right or a left footwear article; and bending the metal sole plate so that the forward portion thereof extends upwardly at an angle with respect to the rearward portion when the sole plate surface conforming to the determined right or left footwear article is up.

17. A method of fitting a footwear adapter comprising:

providing a sole plate conforming to the underside of a footwear article, said sole plate having at least one opening therethrough for receiving a strap connector, the sole plate opening having a dimension extending inward with respect to an edge of the sole plate and further having teeth formed along opposite edges of the inward extending dimension;

providing an adjustable strap connector having a first portion adapted to be received within and in the same plane as the sole plate opening and a second portion distal from the first portion and extending outward therefrom, the first portion of the strap connector having teeth complimentary to and engagable with the teeth in the sole plate opening and being positionable within the sole plate opening in different rigid positions along the inwardly extending dimension;

providing a strap adapted to be attached to the strap connector at the second portion for securing said sole plate to the footwear article;

inserting the first portion of the strap connector into the sole plate opening, engaging the teeth of the strap connector first portion with the teeth of the sole plate opening and adjusting the position of the strap connector first portion in the sole plate opening to a rigid position to fit the width of said footwear article;

applying the sole plate to the underside of the footwear article; and adjusting the strap in the second portion of the strap connector to secure the sole plate to the footwear article.

18. A footwear adapter comprising:

a sole plate conforming to the underside of a footwear article;

at least one opening in said sole plate for receiving a strap connector, the sole plate opening having a dimension extending inward with respect to an edge of the sole plate;

an adjustable strap connector having a first portion received within the sole plate opening and a second portion distal from the first portion and extending outward from the sole plate, the first portion of the strap connector having a threaded opening therein and at least one tab extending outward adjacent to and above the first portion for contacting said sole plate adjacent the opening, the strap connector first portion being positionable within the sole plate opening in different rigid positions along the inwardly extending dimension;

a gripping cleat having a threaded fastener with a width greater than the opening in the sole plate secured in the strap connector portion threaded opening from a side opposite said at least one tab, the gripping cleat threaded fastener and said at least one tab cooperating to secure said strap connector in the opening in said sole plate; and a strap attached to the strap connector at the second portion for securing said sole plate to the footwear article.

19. The footwear adapter of claim 18 wherein the first portion of the strap connector is in the same plane as the opening in the sole plate.

20. The footwear adapter of claim 18 wherein the sole plate opening and the strap connector first portion have complimentary teeth adapted to position the first portion of the strap connector within the sole plate opening in the different positions.

21. The footwear adapter of claim 18 wherein the sole plate is adapted to conform to the forward region of the footwear article and further including a heel plate adapted to conform to the rearward region of the footwear article, the sole plate and the heel plate being adjustably connected to vary distance therebetween.

22. The footwear adapter of claim 21 further including chain links connecting the sole and heel plates, the chain links being adjustable for pitch and number of links to vary the distance between the sole and heel plates.

* * * * *